US012228307B2

(12) United States Patent
Hurt

(10) Patent No.: US 12,228,307 B2
(45) Date of Patent: Feb. 18, 2025

(54) ADJUSTABLE VENT COVER

(71) Applicant: Raymond Hurt, Plain City, OH (US)

(72) Inventor: Raymond Hurt, Plain City, OH (US)

( * ) Notice: Subject to any disclaimer, the term of this patent is extended or adjusted under 35 U.S.C. 154(b) by 379 days.

(21) Appl. No.: 17/690,174

(22) Filed: Mar. 9, 2022

(65) Prior Publication Data

US 2022/0299236 A1 Sep. 22, 2022

Related U.S. Application Data

(60) Provisional application No. 63/162,821, filed on Mar. 18, 2021.

(51) Int. Cl.
*F24F 13/16* (2006.01)
*F24F 13/20* (2006.01)

(52) U.S. Cl.
CPC ..... *F24F 13/16* (2013.01); *F24F 13/20* (2013.01)

(58) Field of Classification Search
CPC ..... F24F 13/16; F24F 13/20
USPC ..... 454/247, 289, 291
See application file for complete search history.

(56) References Cited

U.S. PATENT DOCUMENTS 4,457,215 A * 7/1984 Vogt ..... F24F 13/14 454/307
4,557,183 A * 12/1985 Kolt ..... F24F 13/1426 251/303
4,567,074 A 1/1986 Litaker
4,567,816 A * 2/1986 Kolt ..... F24F 13/1426 137/512.15
4,903,584 A * 2/1990 Styles ..... A61L 9/12 239/57
6,183,359 B1 * 2/2001 Klein ..... F24F 13/082 454/307
6,767,279 B1 * 7/2004 Serrano ..... F24F 13/20 454/270
7,191,845 B2 3/2007 Loar
8,216,034 B1 * 7/2012 Sona ..... F24F 13/085 454/289
9,157,652 B2 * 10/2015 Chamness ..... F24F 11/75
9,237,674 B2 * 1/2016 Hartmann ..... B01D 46/0005
11,149,979 B1 * 10/2021 Parsons ..... F24F 13/084
11,333,392 B1 * 5/2022 Eagan ..... E05D 7/009
2004/0072536 A1 4/2004 Charron
2007/0011930 A1 1/2007 Yarmosh
2010/0022318 A1 1/2010 Munaretto et al.
2010/0233952 A1 9/2010 Mavroudis et al.
(Continued)

*Primary Examiner* — Avinash A Savani
*Assistant Examiner* — Dana K Tighe
(74) *Attorney, Agent, or Firm* — Boudwin Intellectual Property Law, LLC; Daniel Boudwin

(57) ABSTRACT

An adjustable vent cover includes a base having a perimeter surface surrounding a central opening. A cover is connected to the base via one or more hinges. The cover includes an interior volume accessible via a slot disposed on a forward-facing edge of the cover. The cover is biased toward a closed position that closes off the opening of the base. A register or vent is operably connected to the base. The cover is configured to move to an open position via forced air from the vent, and to return to the closed position when the airflow ceases. The cover may be transparent and include a decorative card that can be inserted into the slot. The cover may further include a scent card with a diffusive scent material. The lower side of the cover may include louvers such that airflow passes over the scent card.

14 Claims, 3 Drawing Sheets

(56) References Cited

U.S. PATENT DOCUMENTS

| | | | |
|---|---|---|---|
| 2014/0011439 | A1 | 1/2014 | Young |
| 2015/0047860 | A1 | 2/2015 | Rutherford |

* cited by examiner

ADJUSTABLE VENT COVER

CROSS-REFERENCE TO RELATED APPLICATIONS

This application claims the benefit of U.S. Provisional Application No. 63/162,821 filed on Mar. 18, 2021. The above identified patent application is herein incorporated by reference in its entirety to provide continuity of disclosure.

BACKGROUND OF THE INVENTION

The present invention relates to a vent cover for an HVAC register or similar type of vent. More specifically, the present invention provides an adjustable vent cover that is configured to remain closed until airflow exits the vent and causes the cover to move to an open position.

Many homes and other buildings include HVAC systems with registers or other types of vents installed throughout the building. These vents provide an outlet for the forced air from the HVAC systems to cool or heat the building as needed. Most often, the vents are located on the floor. This placement leads to certain issues. For example, many vents are permanently open, and debris can fall into them easily, potentially clogging them HVAC system over time, and causing items to be lost. Other vents include louvers that must be manually opened and closed, which can be time consuming and a hassle, such that most individuals just leave the vent open permanently. This leads to the previously mentioned issue of losing debris and items through vent openings to be a more consistent problem.

Devices exist in the known art that relate to vent covers for HVAC vents. While covers exist for the vents, many of them have issues and drawbacks. For example, most of these covers must be manually installed and then manually removed in order for the vent to function again, which takes time and is inconvenient to do repeatedly. Other covers with more functionality exist, but these still lack additional features that would provide enhanced benefits to consumers. For example, most vent covers look identical to one another, and provide no means for customization to suit the user's tastes. Other vent covers that currently exist in the known art further lack a means to include an air freshener or fragrance, and such devices must be utilized separately. Other devices in the known art further require additional fasteners or other tools to secure the cover to the vent, which makes them inconvenient to use.

In light of the devices disclosed in the known art, it is submitted that the present invention substantially diverges in design elements from the known art and consequently it is clear that there is a need in the art for an improvement to vent covers, particularly with regard to the above-described need for a vent cover that automatically adjusts between open and closed positions, while also providing enhanced customization options, easier installation, and other desirable features that the devices in the known art lack. In this regard the present invention substantially fulfills these needs.

SUMMARY OF THE INVENTION

The present invention provides an adjustable vent cover wherein the same can be utilized for effectively covering a vent such that the cover automatically opens when the HVAC system is running, and closes when the HVAC system is off. In general, the device includes a base having a perimeter surface surrounding a central opening. A cover is connected to the base via a hinge, and the cover includes an upper surface, a lower surface, and an interior volume therebetween. A slot is disposed on a forward-facing edge of the cover that extends to the interior volume of the cover. The cover is biased toward a closed position that closes off the opening of the base. Further, the cover is configured to move to an open position via forced air from a vent that is operably coupled to the base.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
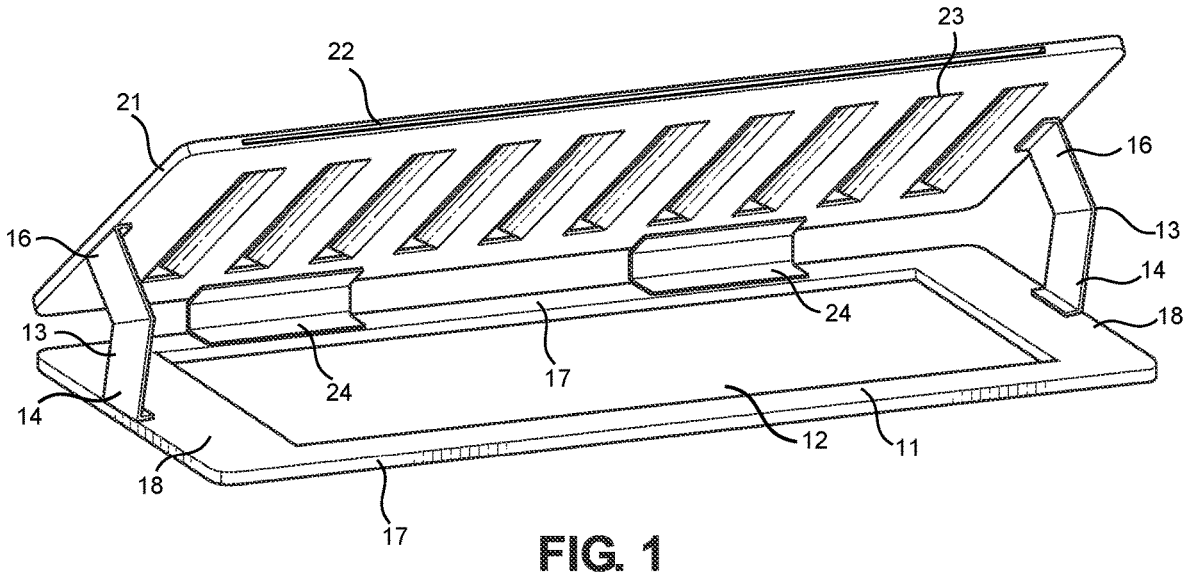
FIG. 1 shows a perspective view of an embodiment of the adjustable vent cover in the open position.

Reference is made herein to the attached drawings. Like reference numerals are used throughout the drawings to depict like or similar elements of the adjustable vent cover. For the purposes of presenting a brief and clear description of the present invention, a preferred embodiment will be discussed as used for covering an HVAC register, vent, or similar structure with a cover that automatically adjusts in position and opens in response to the flow of air therethrough.

Figure 2:
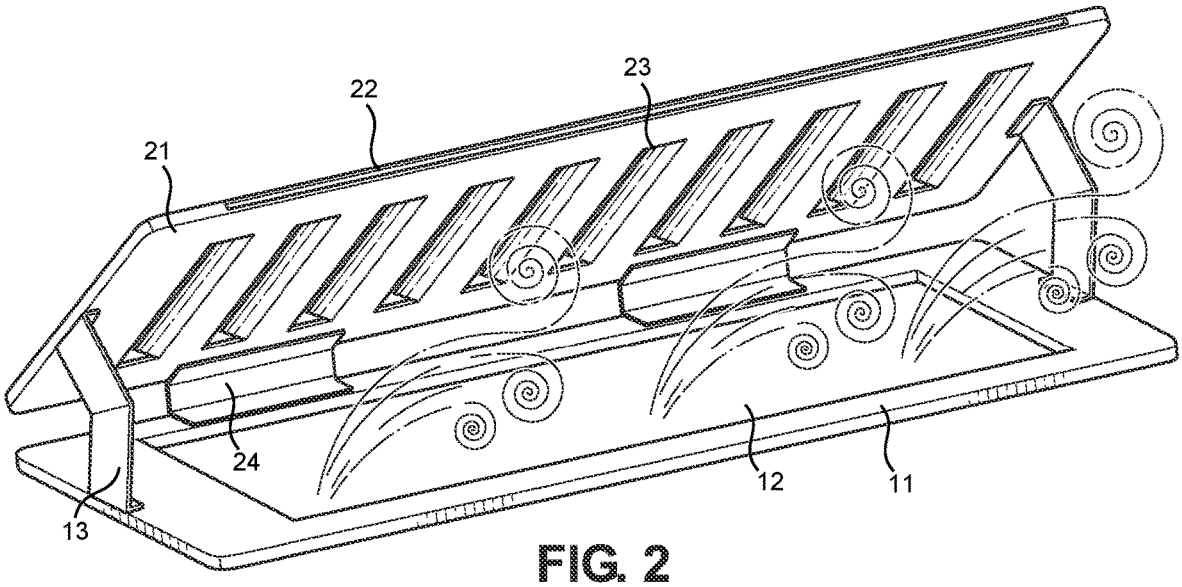
FIG. 2 shows a perspective view of an embodiment of the adjustable vent cover in the open position.
Figure 5:
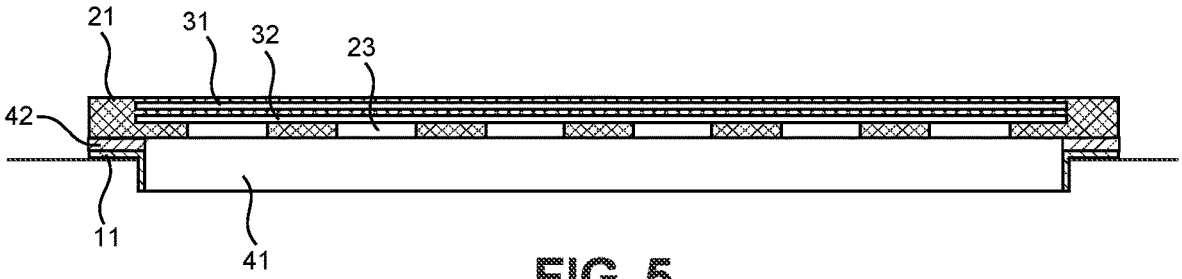
FIG. 5 shows a cross sectional view of an embodiment of the adjustable vent cover with an example vent secured thereto.

Referring now to FIGS. 1 and 2, there are shown perspective views of an embodiment of the adjustable vent cover in the open position. In general, the adjustable vent cover includes a base 11 having a perimeter surface surrounding a central opening 12. The perimeter surface includes a pair of opposing lengthwise edges 17 and a pair of opposing widthwise edges 18. The lengthwise edges and widthwise edges 17, 18 are sized to removable support the perimeter flange or lip of a typical vent, as shown in FIG. 5.

Figure 4:
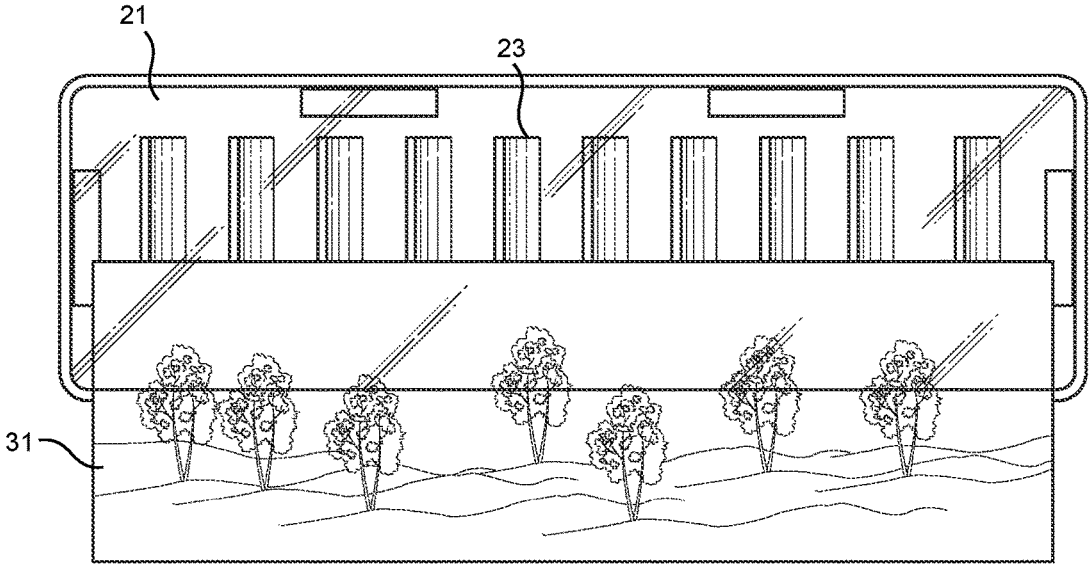
FIG. 4 shows a top plan view of an embodiment of the adjustable vent cover with a decorative insert.

A cover 21 is connected to the base via at least one hinge. The cover 21 is generally identical in size to the base 11. In the shown embodiment, the adjustable vent cover includes a pair of side hinge members 13. Each side hinge member 13 includes a lower portion 14 affixed to one widthwise edge 18 of the base and an upper portion 16 affixed to the lower side of the cover 21. In the shown embodiment, the hinge members 13 include a living hinge that is continuous with the upper portion 16 and the lower portion 14 of the hinge member 13. This allows the hinge members 13 to fold inwardly as the cover 21 closes, such that the hinge members 13 do not extend beyond the edges of the base 11 or the cover 21 when the cover 21 is in the closed position. In other embodiments, other types of hinged or pivoting connections may be utilized for the hinge members 13. The hinge members 13 are configured to bias the cover 21 to a closed position that closes off the opening 12 of the base 11. When air is forced through the vent, the airflow causes the cover 21 to move to the open position, as shown in FIG. 2. The cover 21 further includes an upper surface, a lower surface, and an interior volume therebetween, which is accessible via a slot 22 disposed on a forward-facing edge of the cover 21. As shown in FIG. 4, the slot 22 can be utilized to support a decorative insert or other item.

In the shown embodiment, the adjustable vent cover includes a pair of rear hinge members 24. Similar to the side hinge members 13, each rear hinge member 24 includes a lower portion affixed to a rear lengthwise edge 17 of the base and an upper portion affixed to a rear edge 18 of the base. These additional rear hinges 24 can provide additional structural support for the device. As shown more clearly in FIG. 4, each rear hinge member 24 may further include a spacing element between the upper portion of the rear hinge member 24 and the lower portion of the rear hinge member 24. The spacing element provides additional room to accommodate the vent, such that the cover 21 can lay flat on top of the vent, as shown in FIG. 5.

The shown embodiment additionally includes louvers 23 that are disposed on the lower side of the cover 21, which define openings that extend into the interior volume of the cover 21. This allows the forced air to contact the contents of the interior volume of the cover 21. This can be beneficial when the interior volume of the cover 21 supports a fragrance insert, such that the air can help diffuse the scented material. The louvers 23 further can be positioned such that they align with openings of the supported vent, as shown in FIG. 5, which maximizes the airflow contacting the fragrance emitting insert to increase its effectiveness.

Figure 3:
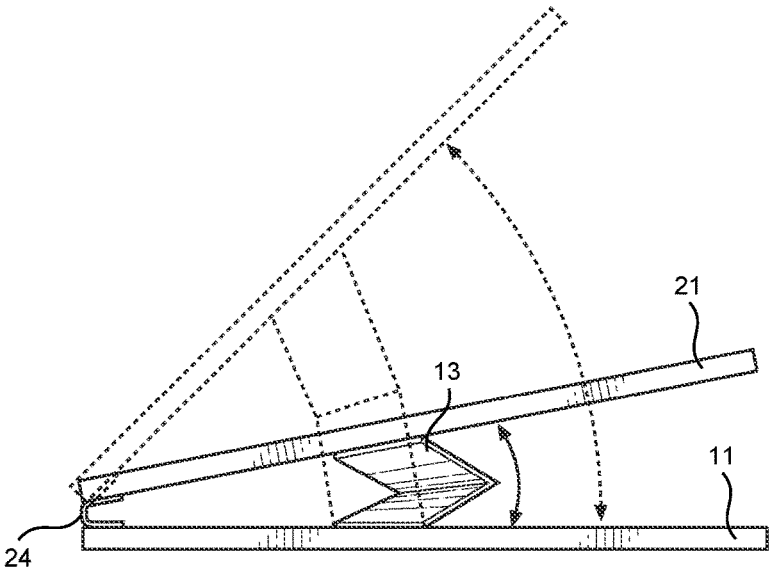
FIG. 3 shows a side view of an embodiment of the adjustable vent cover, detailing the movement between the open position and the closed position.

Referring now to FIG. 3, there is shown a side view of an embodiment of the adjustable vent cover, detailing the movement between the open position and the closed position. In the shown embodiment, the hinge 13 is constructed in such a way that allows for the hinge members 13 to fold inwardly as the cover 21 closes, such that the hinge members 13 do not extend beyond the edges of the base 11 or the cover 21 when the cover 21 is in the closed position. Further, the rear hinge 24 can form a space that receives the body of the vent, the edges of which are supported on the base 11, as shown in FIG. 5.

Referring now to FIG. 4, there is shown a top plan view of an embodiment of the adjustable vent cover with a decorative insert. In the shown embodiment, the cover 21 is composed of a transparent material. This allows a decorative card or insert 31, which includes indicia on at least one side thereof, to be visible through the top surface of the cover 21. The decorative card 31 is removably securable within the interior volume of the cover 21 via insertion through the slot. Different cards or inserts 31 can be inserted to customize the appearance of the adjustable vent cover. In some embodiments, the decorative card 31 comprises an embedded diffusive scent material, of any suitable composition in the known art of such diffusive materials. Air passes over the portions of the card 31 exposed via the open louvers 23 on the lower portion of the cover, helping to diffuse the scent material.

Referring now to FIG. 5, there is shown a cross sectional view of an embodiment of the adjustable vent cover with an example vent secured thereto. In some embodiments, a second card 32 is provided separately from the decorative insert or card 31. The second card 32 is not decorative but functions as a scent card, in that it includes an embedded diffusive scent material. The scent card is removably securable within the interior of the cover 21 beneath the decorative card 31 via insertion through slot, such that a lower side of the scent card is exposed to the vent's airflow via the openings defined by the louvers 23. This allows users to independently customize the fragrance via the scent card 32 and the appearance of the vent cover via the decorative card 31.

In operation, a typical vent includes a lower portion 41 extending down into the outlet of the ductwork of the HVAC system, and includes a perimeter flange 42 around the vent opening. The perimeter flange 42 is supported on the lengthwise and widthwise edges of the base 11, such that the vent itself secures the base 11 in place via friction without the need for any additional fasteners. The openings of the vent may align with the louvers 23 so as to increase the airflow that contacts the scent card 32, thereby increasing its effectiveness. When no air is flowing from the vent, the cover 21 is in its closed position, because the weight of the cover 21 causes it to pivot to the closed position and rest on the base 11. When air flows, the cover 21 automatically hinges opens allowing air to escape the vent. In this way, the cover 21 remains closed when the vents are not needed, preventing items from accidentally falling into the vent during that time, and further opens automatically when the HVAC system is active to allow airflow. The cover 21 is constructed such that the user can customize it with different images and fragrance smells to their liking.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, and all equivalent relationships to those illustrated in the drawings and described in the specification are intended to be encompassed by the present invention.

The foregoing is considered as illustrative only of the principles of the invention. Further, it is not desired to limit the invention to the exact construction and operation shown and described, and accordingly, all suitable modifications and equivalents may be resorted to, falling within the scope of the invention.

I claim:

1. An adjustable vent cover, comprising:

a base having a perimeter surface surrounding a central opening;

a cover connected to the base via a hinge, the cover having an upper surface, a lower surface, and an interior volume therebetween;

a slot disposed on a forward-facing edge of the cover that extends to the interior volume of the cover;

wherein the cover is biased toward a closed position that closes off the central opening of the base;

wherein the cover is configured to move to an open position via forced air from a vent that is operably coupled to the base;

further comprising a plurality of louvers disposed on the lower surface of the cover;

wherein each louver defines an opening into the interior volume of the cover;

wherein each louver of the plurality of louvers is positioned so as to align each louver with one vent slot opening with a plurality of vent slot openings of the vent;

further comprising a decorative card having indicia on at least one side thereof;

wherein the decorative card is removably securable within the interior volume of the cover via insertion through the slot;

further comprising a second card that is a scent card;

wherein the scent card is removably securable within the interior of the cover beneath the decorative card via insertion through the slot, such that a lower side of the scent card is exposed to open air via the openings defined by the plurality of louvers; and wherein the scent card includes an embedded diffusive scent material.

2. The adjustable vent cover of claim 1, wherein the cover is transparent.

3. The adjustable vent cover of claim 1, wherein the decorative card includes the embedded diffusive scent material.

4. The adjustable vent cover of claim 1, wherein the hinge includes a pair of hinge members, wherein each hinge member includes a lower portion affixed to the base and an upper portion affixed to the cover.

5. The adjustable vent cover of claim 4, wherein each hinge member further comprises a living hinge that is continuous with the upper portion and the lower portion of the hinge member.

6. The adjustable vent cover of claim 4, further comprising a pair of rear hinge members, each rear hinge member includes an upper portion affixed to a rear edge of the cover and a lower portion affixed to a rear edge of the base.

7. The adjustable vent cover of claim 6, wherein each rear hinge member further comprises a spacing element between the upper portion of the rear hinge member and the lower portion of the rear hinge member.

8. An adjustable vent cover and vent system, comprising:

a base having a perimeter surface surrounding a central opening;

a cover connected to the base via a hinge, the cover having an upper surface, a lower surface, and an interior volume therebetween;

a slot disposed on a forward-facing edge of the cover that extends to the interior volume of the cover;

a vent having a lower portion extending through the central opening of the base and a perimeter edge that is supported on a perimeter lip;

wherein the cover is biased toward a closed position that closes off the central opening of the base;

wherein the cover is configured to move to an open position via forced air from the vent that is operably coupled to the base;

further comprising a scent card;

wherein the scent card is removably securable within the interior of the cover beneath a decorative card via insertion through the slot, such that a lower side of the scent card is exposed to open air via the openings defined by the plurality of louvers; and wherein the scent card comprises an embedded diffusive scent material.

9. The adjustable vent cover and vent system of claim 8, wherein the cover is transparent.

10. The adjustable vent cover and vent system of claim 8, wherein the vent is removably secured to the base.

11. The adjustable vent cover and vent system of claim 8, further comprising a plurality of louvers disposed on the lower surface of the cover, wherein each louver defines an opening into the interior volume of the cover.

12. The adjustable vent cover and vent system of claim 11, wherein each louver of the plurality of louvers is positioned so as to align each louver with one vent slot opening with a plurality of vent slot openings of the vent.

13. The adjustable vent cover and vent system of claim 8, wherein the decorative card having indicia on at least one side thereof, wherein the decorative card is removably securable within the interior volume of the cover via insertion through the slot.

14. The adjustable vent cover and vent system of claim 8, wherein the decorative card includes the embedded diffusive scent material.

* * * * *